US007726760B2

(12) United States Patent
Ikefuji et al.

(10) Patent No.: US 7,726,760 B2
(45) Date of Patent: Jun. 1, 2010

(54) PRINTING APPARATUS, METHOD OF INSPECTING NOZZLES FOR ABNORMALITIES, AND PROGRAM

(75) Inventors: Kunio Ikefuji, Kyoto (JP); Tsuyoshi Okuda, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 814 days.

(21) Appl. No.: 11/491,931

(22) Filed: Jul. 25, 2006

(65) Prior Publication Data

US 2007/0040878 A1 Feb. 22, 2007

(30) Foreign Application Priority Data

Aug. 22, 2005 (JP) ..... 2005-239630

(51) Int. Cl.
*B41J 29/38* (2006.01)

(52) U.S. Cl. ..... 347/13; 347/5; 347/19

(58) Field of Classification Search ..... 347/13–14, 347/5, 9, 15, 19, 90

See application file for complete search history.

(56) References Cited

U.S. PATENT DOCUMENTS

2005/0030327 A1 * 2/2005 Tatsumi ..... 347/13

* cited by examiner

*Primary Examiner*—Lam S Nguyen
(74) *Attorney, Agent, or Firm*—McDermott Will & Emery LLP

(57) ABSTRACT

A printing apparatus records a predetermined test pattern on printing paper, and reads the test pattern by means of a scanner. The scanner reads the test pattern at a resolution lower than the resolution of a recording head. This allows the automatic and fast reading of the test pattern. Additionally, the printing apparatus performs an interpolation process on read data, and judges whether there is an abnormality in nozzles or not, based on the read data subjected to the interpolation process. This reproduces the positions of and spacing between lines recorded on the printing paper with high accuracy to achieve the exact judgment as to whether there is an abnormality in the nozzles or not. Therefore, an inspection with a high degree of reliability is accomplished.

18 Claims, 8 Drawing Sheets

PRINTING APPARATUS, METHOD OF INSPECTING NOZZLES FOR ABNORMALITIES, AND PROGRAM

BACKGROUND OF THE INVENTION

1. Field of the Invention

The present invention relates to a technique for inspecting nozzles for abnormalities in an inkjet printing apparatus.

2. Description of the Background Art

Inkjet printing apparatuses are conventionally known. An inkjet printing apparatus includes a plurality of nozzles for ejecting ink, and records an image on printing paper by ejecting ink from each of the nozzles toward the printing paper while moving the nozzles and the printing paper relative to each other. Such inkjet printing apparatuses are widely used in the step of printing because of their relatively low running costs.

Since the inkjet printing apparatus ejects ink from the plurality of nozzles as mentioned above, the quality of images recorded by the inkjet printing apparatus deteriorates if an abnormality occurs in some of the nozzles. The quality of the recorded images deteriorates, for example, if ink is no longer ejected from some of the nozzles, a line printed by the ink ejected from some of the nozzles has a reduced width, or the ink ejected from some of the nozzles is not placed in proper positions.

Such nozzle abnormalities result from the entry of air into the nozzles, the deposition of dust onto the nozzles, and other factors. It has hence been difficult to automatically detect the nozzle abnormalities by effecting electrical control of the interior of the printing apparatus. For this reason, whether there is a nozzle abnormality or not has been judged by a user that views a predetermined test pattern printed on printing paper by the eyes.

However, viewing the printed test pattern by the eyes becomes an enormous burden on the user. In particular, it takes a considerable amount of time for an unskilled user to perform this viewing operation. Depending on the color of the ink ejected from the nozzles, there are cases in which viewing the test pattern by the eyes is difficult. In such cases, it has been difficult to reliably inspect the nozzles for abnormalities.

SUMMARY OF THE INVENTION

The present invention is intended for an inkjet printing apparatus.

According to the present invention, the inkjet printing apparatus comprises: a recording head including a plurality of nozzles for ejecting ink onto printing paper, the recording head recording an image on the printing paper at a predetermined resolution; a scanner for reading a predetermined test pattern recorded by the recording head at a resolution lower than the resolution of the recording head; an interpolation processing part for performing an interpolation process on read data, the read data being read by the scanner; and a judgment part for judging whether there is an abnormality in the nozzles or not, based on the read data subjected to the interpolation process by the interpolation processing part.

The test pattern recorded on the printing paper is read at a resolution lower than the resolution of the recording head. This allows the automatic and fast reading of the test pattern. Additionally, the interpolation process is performed on the read data, and whether there is an abnormality in the nozzles or not is judged based on the read data subjected to the interpolation process. This reproduces the positions of and spacing between lines contained in the test pattern recorded on the printing paper with high accuracy to achieve the exact judgment as to whether there is an abnormality in the nozzles or not. Therefore, an inspection with a high degree of reliability is accomplished.

Preferably, the interpolation processing part performs the interpolation process on the read data to thereby generate the read data with a resolution higher than the resolution of the recording head.

This reproduces the positions of and spacing between the lines contained in the test pattern recorded on the printing paper with higher accuracy.

Preferably, the judgment part makes a comparison between the read data subjected to the interpolation process by the interpolation processing part and ideal data based on an ideal test pattern to thereby judge whether there is an abnormality in the nozzles or not.

The presence or absence of a clogged nozzle, a thin-line nozzle and an improper-droplet-path nozzle is appropriately judged based on a difference between the read data and the ideal data.

Preferably, the judgment part binarizes the read data subjected to the interpolation process by the interpolation processing part by using a predetermined threshold value as a reference, and judges whether there is an abnormality in the nozzles or not, based on the binarized read data.

The size of and spacing between graphics contained in the test pattern are easily acquired.

Preferably, the inkjet printing apparatus further comprises a threshold value setting element for setting the threshold value.

A user can set the threshold value at an optimum value in accordance with the color of the ink and the color of the printing paper.

Preferably, the inkjet printing apparatus further comprises a transport part for transporting the printing paper. While being held stationary, the recording head records an image on the printing paper being transported in one direction by the transport part.

Such a one-pass type printing apparatus is capable of high-speed printing but is disadvantageous in that the printing quality thereof deteriorates if there is an abnormality in any one of the nozzles. The present invention, however, provides the inspection of the nozzles for abnormalities without difficulties.

Preferably, the scanner includes a plurality of image pickup devices, and the inkjet printing apparatus further comprises an averaging part for averaging data read by the plurality of image pickup devices.

This achieves more precise acquisition of data about the test pattern recorded on the printing paper to improve the accuracy of the inspection.

The present invention is also intended for a method of inspecting a plurality of nozzles for abnormalities in an inkjet printing apparatus including a recording head, the recording head including the plurality of nozzles, the plurality of nozzles ejecting ink onto printing paper, the recording head recording an image on the printing paper.

The present invention is also intended for a program for an inkjet printing apparatus, the inkjet printing apparatus including a recording head having a plurality of nozzles for ejecting ink onto printing paper, a scanner for reading an image recorded on the printing paper, and a controller for controlling the recording head and the scanner, the program being executed by a computer provided in the controller.

It is therefore an object of the present invention to provide a technique capable of inspecting nozzles for abnormalities automatically at high speeds with reliability in an inkjet printing apparatus.

These and other objects, features, aspects and advantages of the present invention will become more apparent from the following detailed description of the present invention when taken in conjunction with the accompanying drawings.

DESCRIPTION OF THE PREFERRED EMBODIMENTS

A preferred embodiment according to the present invention will now be described with reference to the drawings.

<1. Construction of Printing Apparatus>

Figure 1:
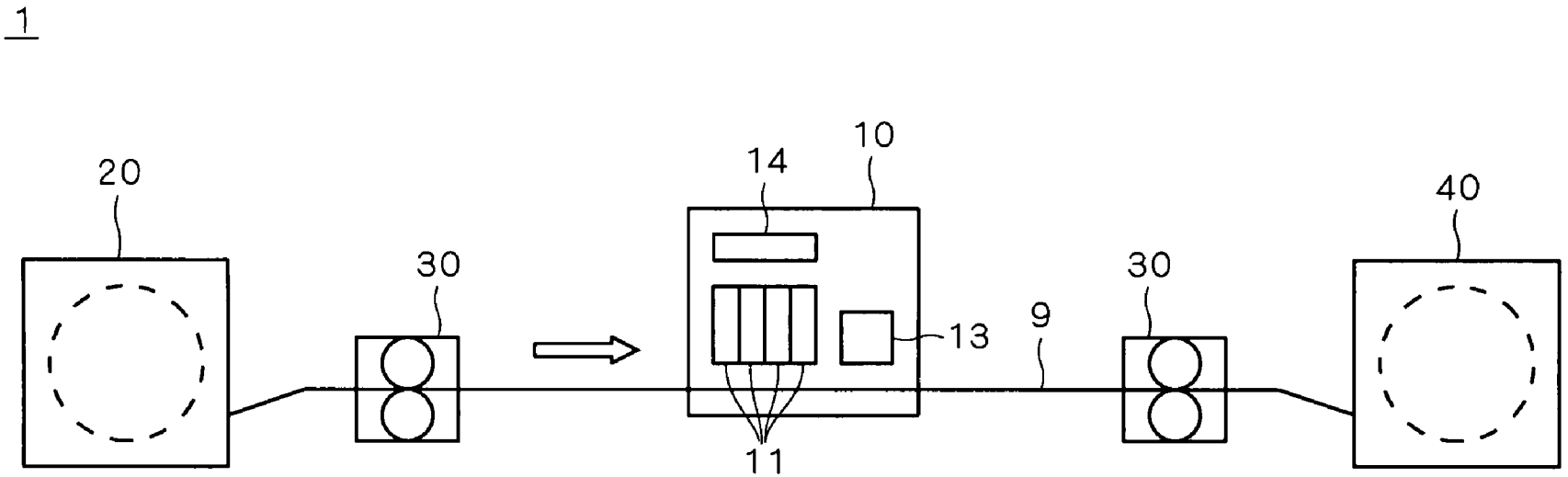
FIG. 1 shows a mechanical construction of a printing apparatus.

FIG. 1 shows a mechanical construction of a printing apparatus 1 according to the present invention. The printing apparatus 1 is an inkjet color printing apparatus comprising a recording unit 10, a feed part 20, a transport part 30 and a take-up part 40. A web (or elongated piece) of printing paper 9 unwound and fed from the feed part 20 is transported in a direction indicated by the arrow of FIG. 1 by the transport part 30. The recording unit 10 records an image on an upper surface of the printing paper 9 being transported. The printing paper 9 having passed through the recording unit 10 is further transported, and is received by the take-up part 40.

The recording unit 10 includes four recording heads 11 for printing using respective color inks of Y (yellow), M (magenta), C (cyan) and K (black) serving as the color components of color printing. Images of the respective colors from the recording heads 11 are recorded on the printing paper 9 to form a single color image.

Figure 2:
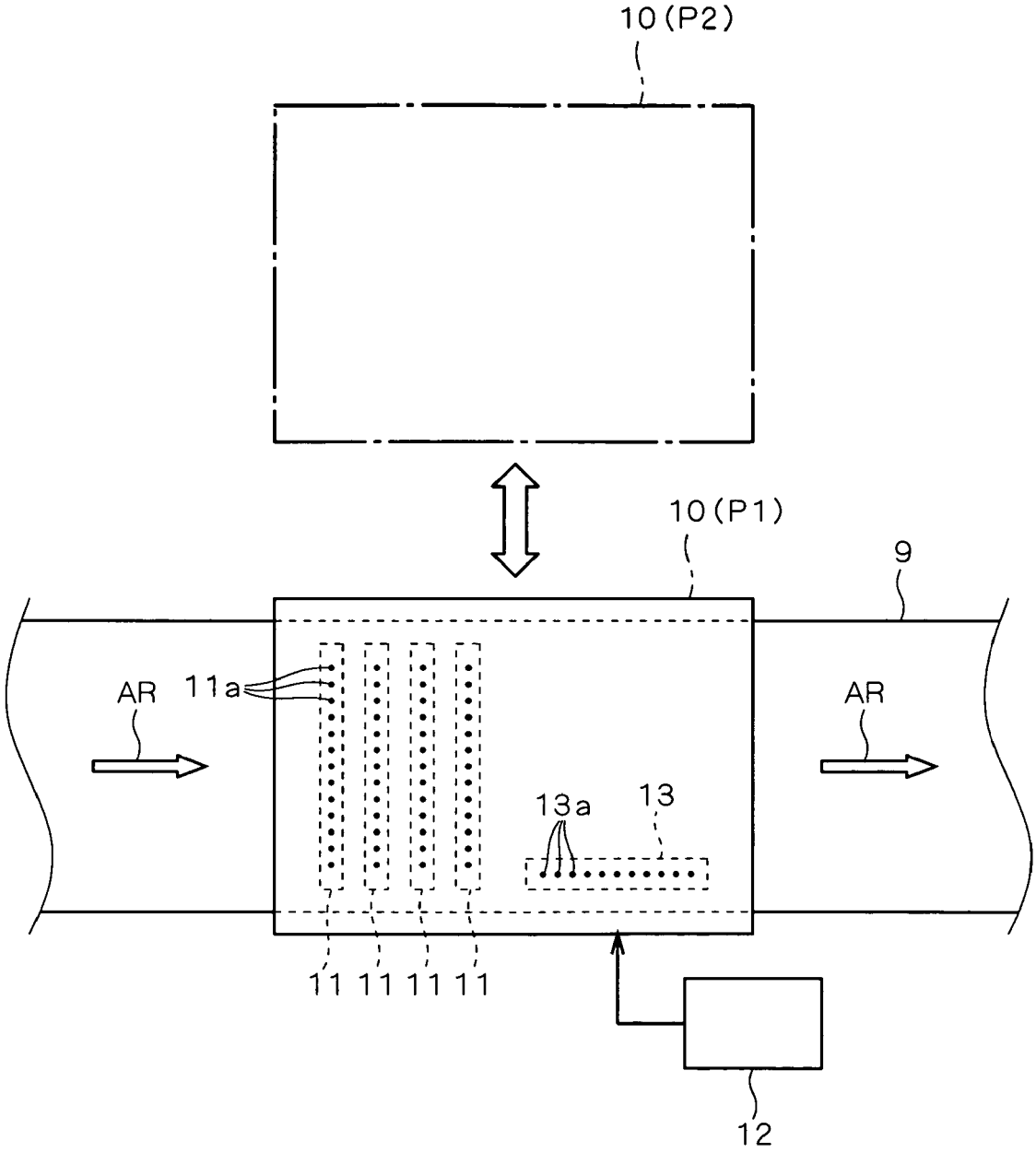
FIG. 2 is a top plan view of a recording unit.

FIG. 2 is a top plan view of the recording unit 10. Each of the four recording heads 11 includes a plurality of nozzles 11*a* arranged in a line in a direction transverse to the printing paper 9. The recording heads 11 record an image on the printing paper 9 by ejecting ink from the nozzles 11*a* toward the printing paper 9. An amount of ink ejected from each of the nozzles 11*a* corresponds to one dot of the image recorded on the printing paper 9.

A drive mechanism 12 conceptually shown in FIG. 2 is connected to the recording unit 10. When the drive mechanism 12 is actuated, the recording unit 10 moves between a recording position P1 in which the recording unit 10 records an image on the printing paper 9 and a standby position P2 in which the recording unit 10 is in a standby condition at the side of the printing paper 9. When the printing apparatus 1 records an image on the printing paper 9, the drive mechanism 12 causes the recording unit 10 to move to the recording position P1. With the recording unit 10 held stationary in the recording position P1, the printing apparatus 1 transports the printing paper 9 in a direction indicated by the arrows AR of FIG. 2, and ejects ink from the plurality of nozzles 11*a* onto the printing paper 9. When the printing apparatus 1 performs no recording operation, the recording unit 10 is held in a standby condition in the standby position P2.

Figure 3:
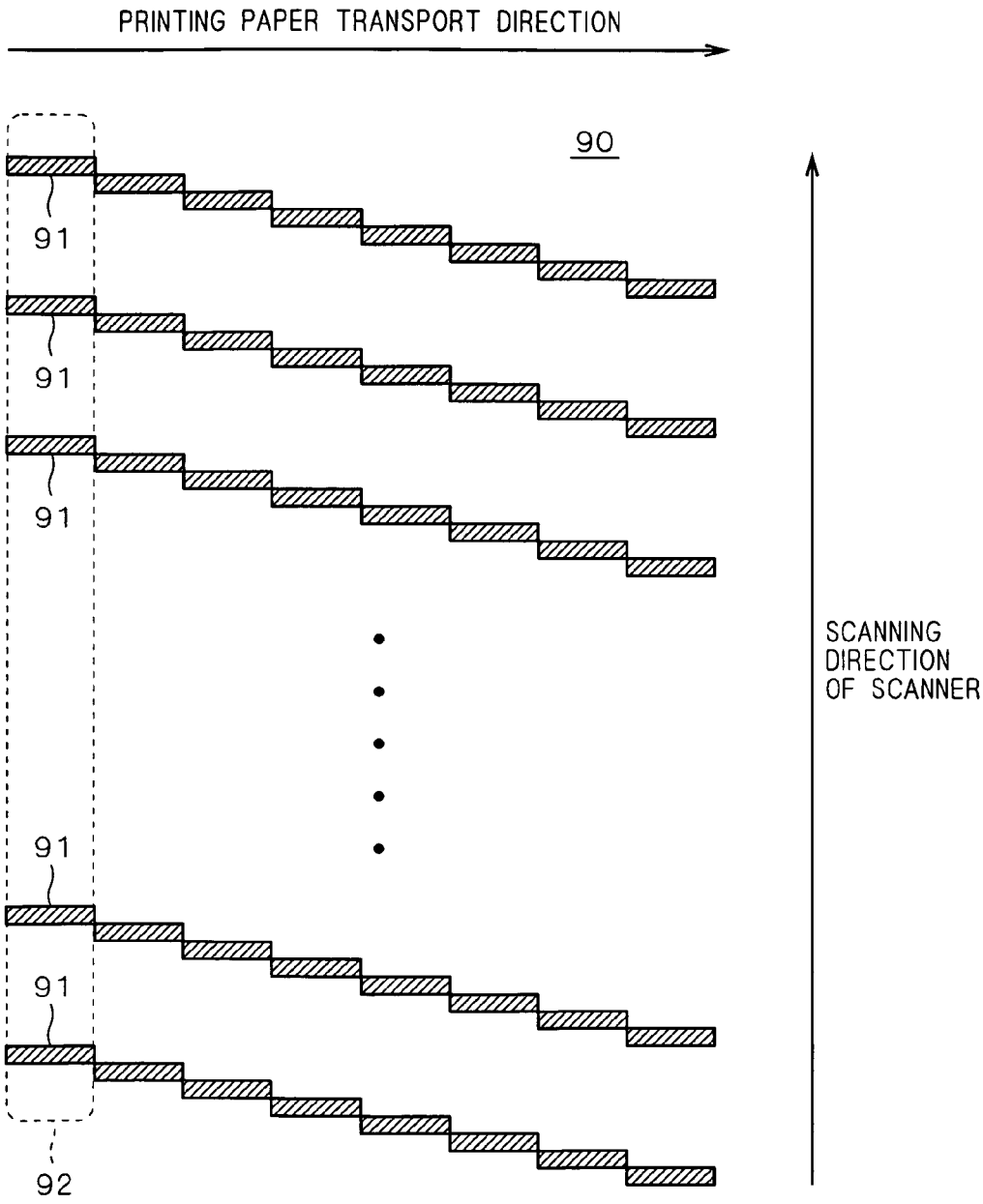
FIG. 3 shows an example of a test pattern.

The recording heads 11 are capable of recording test patterns 90 for inspection of the nozzles 11*a* for abnormalities on the printing paper 9. FIG. 3 shows an example of the test patterns 90 recorded by the recording heads 11. This test pattern 90 is a so-called "1-on-N-off" test pattern formed by recording a plurality of column patterns 92 each of which includes a plurality of lines 91 having a width corresponding to one dot and spaced a predetermined distance apart from each other, each of the column patterns 92 being displaced one dot from its adjacent one in the direction transverse to the printing paper 9. Each and every one of the nozzles 11*a* of the recording heads 11 is used to record one line 91 of the test pattern 90. It should be noted that each of the four recording heads 11 prints the test pattern 90 as shown in FIG. 3.

Referring again to FIGS. 1 and 2, the recording unit 10 includes a scanner 13 for reading the test patterns 90 recorded on the printing paper 9. The scanner 13 is disposed within the recording unit 10 in a location downstream of the recording heads 11 in the transport direction of the printing paper 9. The scanner 13 includes a plurality of image pickup devices 13*a* (for example, CCD elements). The plurality of image pickup devices 13*a* arranged in a line in the transport direction of the printing paper 9.

After the recording heads 11 record the respective test patterns 90 on the printing paper 9, the transport part 30 transports the printing paper 9 so that the test patterns 90 are moved to the reading position of the scanner 13. The recording unit 10 moves from the recording position P1 to the standby position P2, whereby the scanner 13 scans the test patterns 90 to read the test patterns 90 recorded on the printing paper 9.

As shown in FIG. 1, the recording unit 10 further includes a cleaning part 14 for cleaning the nozzles 11*a* when an abnormality is detected in any nozzle 11*a*.

Figure 4:
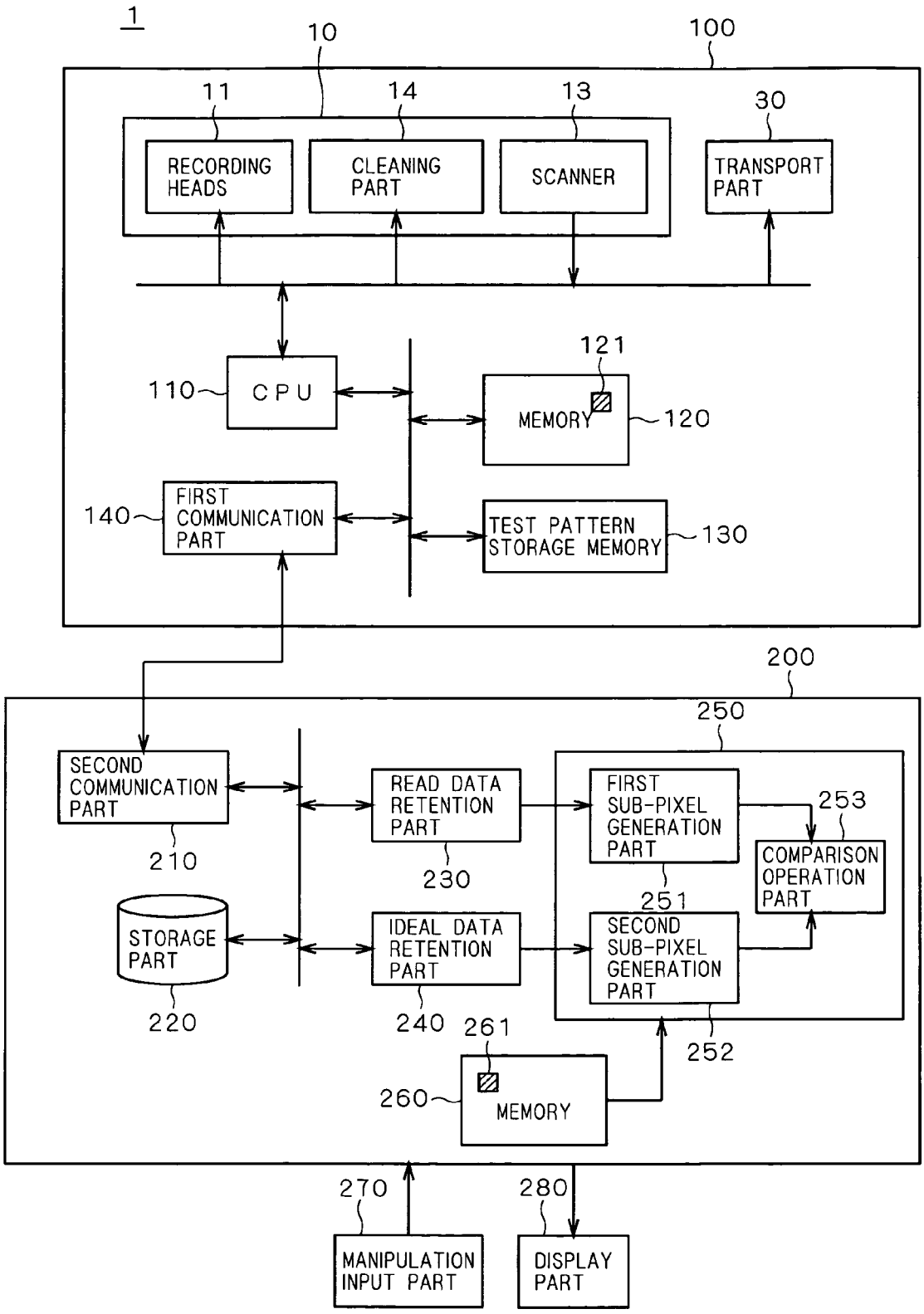
FIG. 4 is a block diagram showing an electrical construction of the printing apparatus.

FIG. 4 is a block diagram showing an electrical construction of the printing apparatus 1. The printing apparatus 1 includes an apparatus body part 100 and a computer part 200. The apparatus body part 100 includes the mechanical parts such as the recording unit 10 and the transport part 30 shown in FIG. 1, and further includes a CPU 110, a memory 120, a test pattern storage memory 130, and a first communication part 140. The CPU 110 controls the operations of the recording unit 10 and the transport part 30, based on a computer program 121 stored in the memory 120. This causes the execution of the transport of the printing paper 9, the recording of an image, the scan of the scanner 13, and the like. During the recording of the test patterns 90, the CPU 110 controls the recording unit 10 and the transport part 30, based on the above-mentioned computer program 121 and data about the test patterns 90 stored in the test pattern storage memory 130.

The computer part 200 includes a second communication part 210, a storage part 220, a read data retention part 230, an ideal data retention part 240, a computation part 250, and a memory 260. The computer part 200 is connected to the apparatus body part 100 through the first and second communication parts 140 and 210.

The data (referred to hereinafter as "read data") about the test patterns 90 read by the scanner 13 of the apparatus body part 100 is transmitted through the first and second communication parts 140 and 210 to the read data retention part 230 in the computer part 200, and is retained in the read data retention part 230. The read data retained in the read data retention part 230 is transmitted to a first sub-pixel generation part 251 in the computation part 250, and is subjected to an interpolation process in the first sub-pixel generation part 251. On the other hand, data (referred to hereinafter as "ideal data") about an ideal test pattern 90 is retained in the ideal data retention part 240. The ideal test pattern refers to a test pattern recorded by each of the recording heads 11 in the absence of any nozzle abnormality. For example, a test pattern printed when the recording heads 11 operate under normal conditions may be used as the ideal data. Alternatively, a test pattern logically expected and generated based on specifications of the recording heads 11 may be used as the ideal data. The ideal data retained in the ideal data retention part 240 is transmitted to a second sub-pixel generation part 252 in the computation part 250, and is subjected to an interpolation process in the second sub-pixel generation part 252.

The read data subjected to the interpolation process in the first sub-pixel generation part 251 and the ideal data subjected to the interpolation process in the second sub-pixel generation part 252 are transmitted to a comparison operation part 253. The comparison operation part 253 makes a comparison between the input data received from the first sub-pixel generation part 251 and the ideal data received from the second sub-pixel generation part 252 to judge whether there is an abnormality in the nozzles 11*a* or not. The computation part 250 is implemented, for example, by a CPU. The computation part 250 performs a computation process, based on a computer program 261 stored in the memory 260 to implement the functions of the first and second sub-pixel generation parts 251 and 252 and the comparison operation part 253 described above.

A manipulation input part 270 and a display part 280 are connected to the computer part 200. The manipulation input part 270 is manipulated by a user to input various parameters and the like to the computer part 200. The display part 280 displays a result of the inspection of the nozzles 11*a* and the like to a user.

<2. Flow of Inspection of Nozzles for Abnormalities>

Figure 5:
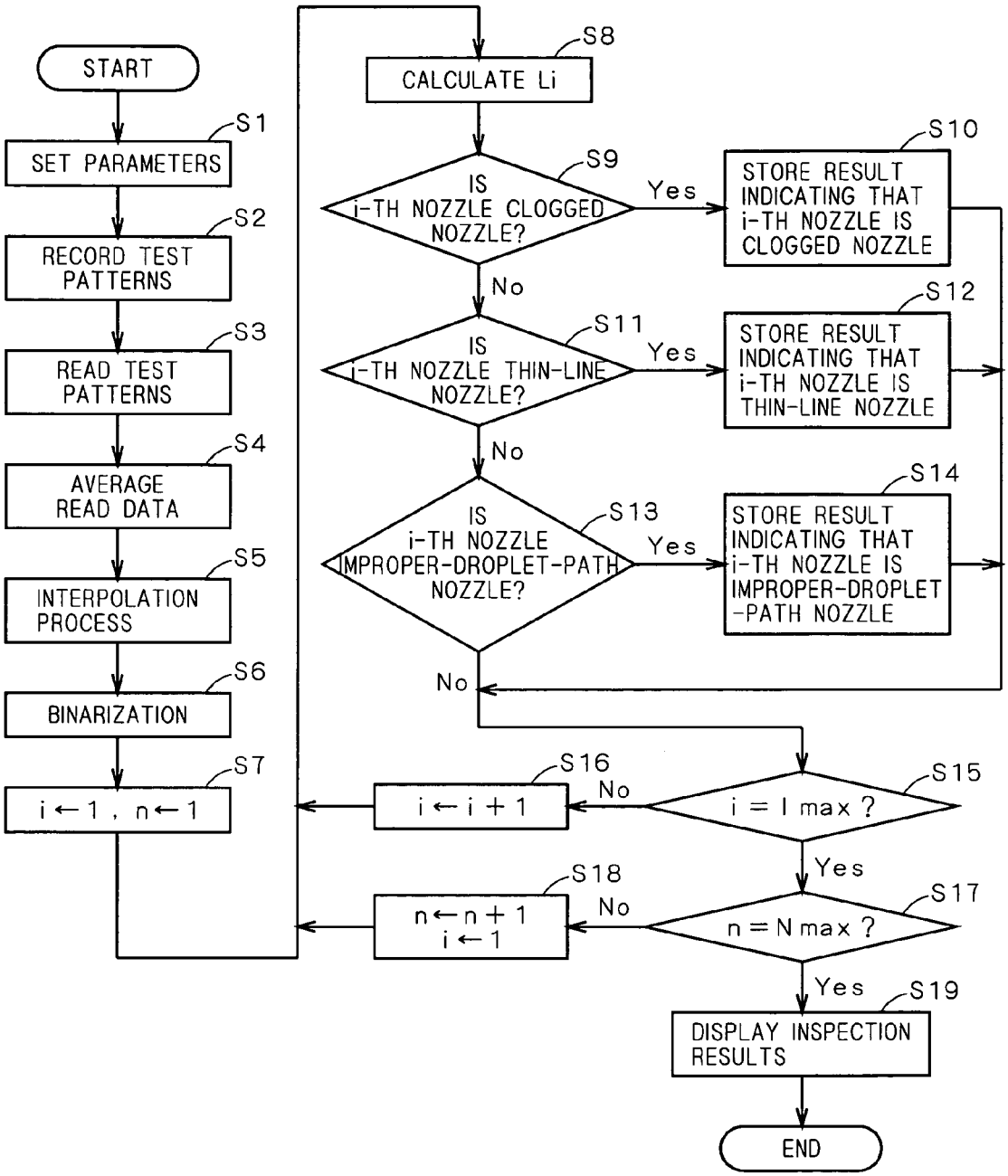
FIG. 5 is a flow chart showing an operational flow for inspection of nozzles for abnormalities.

Next, the operation for the inspection of the nozzles 11*a* for abnormalities in the printing apparatus 1 having the above-mentioned construction will be described. FIG. 5 is a flow chart showing an operational flow for the inspection of the nozzles 11*a* for abnormalities. The operation to be described below is accomplished by the control operation of the CPU 110 based on the computer program 121 in the memory 120 and the computation process of the computation part 250 based on the computer program 261 in the memory 260.

For the inspection of the nozzles 11*a* for abnormalities, the first step is to set various parameters necessary for the inspection (in Step S1). Specifically, the parameters set in Step S1 include the size of an area to be read by the scanner 13, the origin of the area to be read by the scanner 13, the number of pixels to be read for averaging of the read data, the number $N_{max}$ of recording heads 11, the number $I_{max}$ of nozzles 11*a* possessed by each of the recording heads 11, a threshold value $D_j$ for binarization of data, the tolerance d of a line-to-line spacing in the test patterns 90, and the like. These parameters are set by user's entries using the above-mentioned manipulation input part 270.

Next, the printing apparatus 1 causes the drive mechanism 12 to move the recording unit 10 to the recording position P1. Then, the printing apparatus 1 transports the printing paper 9 while ejecting ink from the plurality of nozzles 11*a* of the recording heads 11 onto the printing paper 9, to record the test patterns 90 on the printing paper 9 (in Step S2). In this preferred embodiment, the four recording heads 11 record the test patterns 90 of the respective colors independently.

After the test patterns 90 are recorded, the printing apparatus 1 causes the transport part 30 to transport the printing paper 9, thereby moving the test patterns 90 to the reading position of the scanner 13. Then, the printing apparatus 1 causes the recording unit 10 to move from the recording position P1 to the standby position P2, thereby causing the scanner 13 to scan the test patterns 90. Thus, the scanner 13 reads the test patterns 90 recorded on the printing paper 9 (in Step S3).

Figure 6:
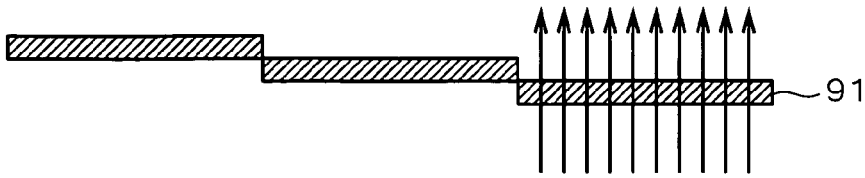
FIG. 6 shows a line in the test pattern and the reading positions of image pickup devices.

The scanner 13 includes the multiplicity of image pickup devices 13*a* arranged in a line. Thus, a plurality of portions of a single line 91 in each test pattern 90 are read by different image pickup devices 13*a*, respectively, in Step S3, as shown in FIG. 6. In the instance of FIG. 6, ten portions of the single line 91 are read. The data read by the plurality of image pickup devices 13*a* are averaged for each line 91, and the averaged data is retained in the read data retention part 230 (in Step S4). In this manner, the printing apparatus 1 reads the plurality of portions of each line 91, and averages the read data. This achieves the correct reading of the position of each line 91 to improve the accuracy of the inspection.

Figure 7:
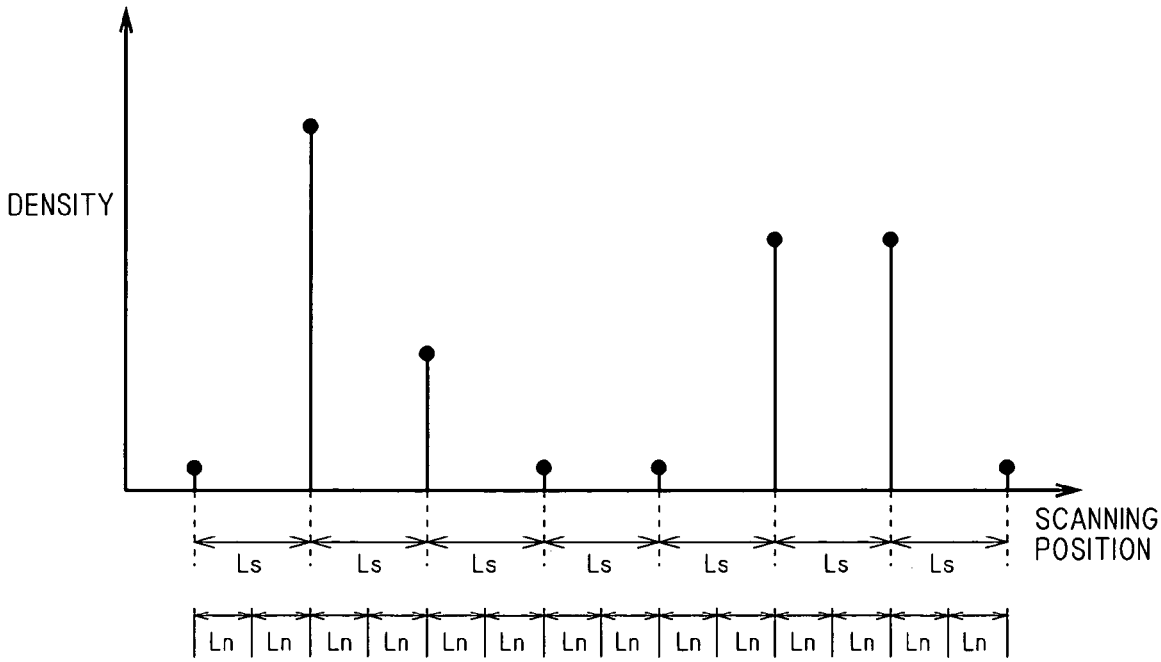
FIG. 7 shows an example of data read by a scanner.

FIG. 7 shows an example of the averaged read data. The abscissa of FIG. 7 represents the scanning position of the scanner 13, and the ordinate represents density on the printing paper 9 corresponding to the scanning position. The scanner 13 reads the test patterns 90 at a resolution lower than the resolution of the recording heads 11 (or the density of the nozzles 11*a*). In other words, the scanner 13 performs the reading operation by using a sampling pitch $L_s$ greater than a dot-to-dot spacing. $L_n$ of the recording heads 11 (or the spacing between the nozzles 11*a*). In the instance of FIG. 7, the reading operation uses the sampling pitch $L_s$ which is twice the dot-to-dot spacing $L_n$ of the recording heads 11. Thus, the scanner 13 can read the test patterns 90 at high speeds because the scanner 13 performs the reading operation at a resolution lower than the resolution of the recording heads 11.

Figure 8:
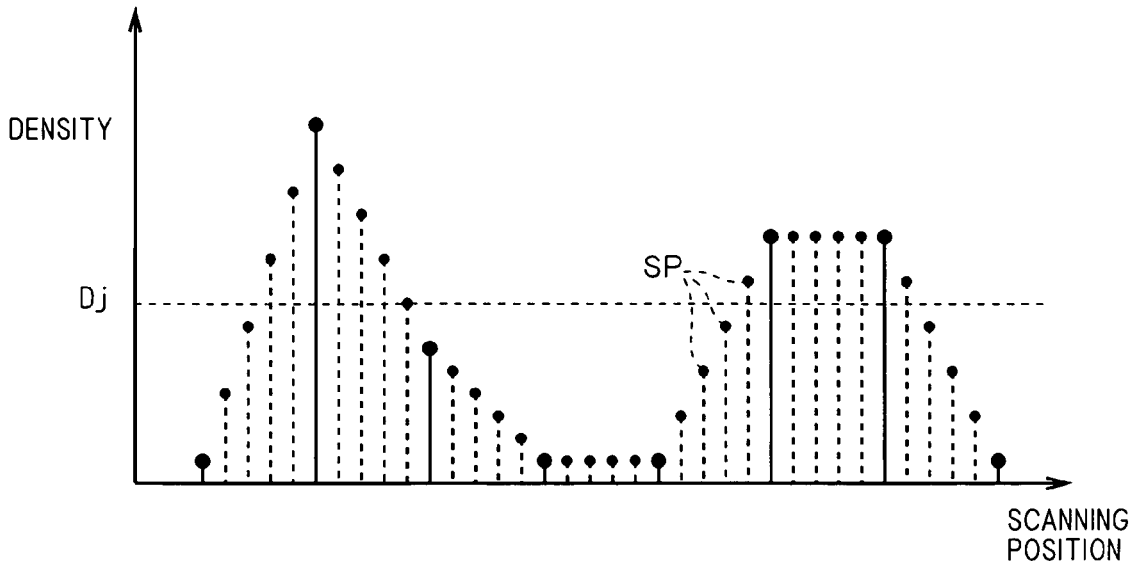
FIG. 8 shows an example of read data after an interpolation process.
Figure 9:
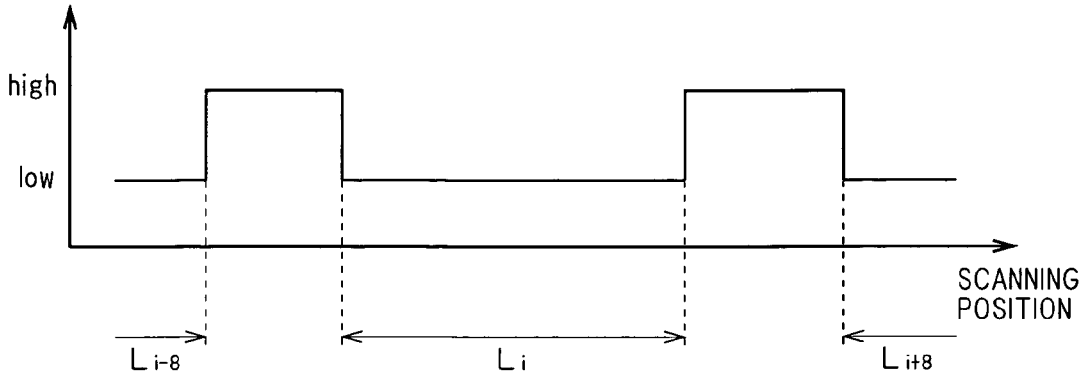
FIG. 9 shows an example of read data after binarization.

The read data retained in the read data retention part 230 is transmitted to the first sub-pixel generation part 251, and is subjected to the interpolation process in the first sub-pixel generation part 251 (in Step S5). FIG. 8 shows an example of the read data of FIG. 7 subjected to the interpolation process. In the instance of FIG. 8, a simple interpolation process in which each sampling pitch $L_s$ is divided into five is performed on the read data to generate sub-pixels SP. Thus, the instance of FIG. 8 creates read data with a resolution higher than the resolution of the recording heads 11. Since such an interpolation process improves the resolution of the read data, the printing apparatus 1 can correctly determine a spacing $L_i$ between the lines 91 in a step to be described below. The interpolation process in Step S5 is not limited to the simple interpolation process for generating the linearly arranged sub-pixels SP as described above, but other various interpolation methods may be used.

The read data subjected to the interpolation process is transmitted to the comparison operation part 253, and is binarized in the comparison operation part 253 (in Step S6). FIG.

9 shows an example obtained by binarizing the interpolated data of FIG. 8 by using the threshold value $D_j$ as a reference. The binarization is carried out in such a manner that a region having a density higher than the threshold value $D_j$ is "high" and a region having a density lower than the threshold value $D_j$ is "low." The "high" region denotes the position of a line 91 recorded by one of the nozzles 11*a*. The length $L_i$ of the "low" region denotes a spacing between adjacent lines 91 (a spacing between a line 91 recorded by an (i−8)th nozzle 11*a* and a line 91 recorded by an i-th nozzle 11*a*; where i is an integer greater than 8). The threshold value $D_j$ is the value set in Step S1 as described above. The threshold value $D_j$ may be varied in accordance with the color of the ink and the color of the printing paper 9.

The second sub-pixel generation part 252 in the computation part 250, on the other hand, performs an interpolation process on the ideal data retained in the ideal data retention part 240 in a manner similar to that described in Step S5. The ideal data subjected to the interpolation process is transmitted to the comparison operation part 253. The comparison operation part 253 performs a binarization process on the received ideal data in a manner similar to that described in Step S6. Thus, the binarized read data and the binarized ideal data are generated in the comparison operation part 253.

After the completion of the binarization process, the comparison operation part 253 judges whether there is an abnormality in each of the nozzles 11*a* or not. For the judgment as to whether there is an abnormality in each of the nozzles 11*a* or not, the first step is to set both a recording head number n assigned to the recording heads 11 and a nozzle number i assigned to the nozzles 11*a* at "1" (in Step S7). The comparison operation part 253 extracts a line-to-line spacing $L_i$ corresponding to the i-th nozzle 11*a* from the binarized read data (in Step S8). At the same time, the comparison operation part 253 extracts an ideal line-to-line spacing $L_c$ from the binarized ideal data. The comparison operation part 253 judges whether there is an abnormality in the i-th nozzle 11*a* or not, based on the line-to-line spacing $L_i$ and the ideal line-to-time spacing $L_c$ (in Steps S9 to S14).

Figure 10:
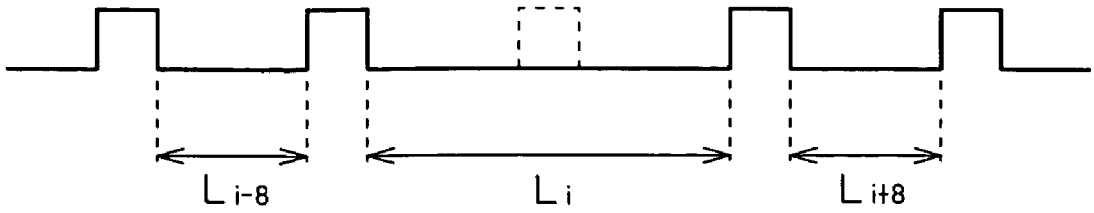
FIG. 10 shows an example of read data in the presence of a clogged nozzle.

First, the comparison operation part 253 judges whether the i-th nozzle 11*a* is a so-called "clogged nozzle" which ejects no ink or not (in Step S9). Specifically, the i-th nozzle 11*a* is judged to be a clogged nozzle when the line-to-line spacing L1 corresponding to the i-th nozzle 11*a* is approximately twice the ideal line-to-line spacing $L_c$ (e.g., $1.8\ L_c \leqq L_i \leqq 2.2\ L_c$), as shown in FIG. 10. The comparison operation part 253 stores the result of the judgment (in Step S10) when the i-th nozzle 11*a* is judged to be a clogged nozzle. Then, the processing proceeds to Step S15.

Figure 11:
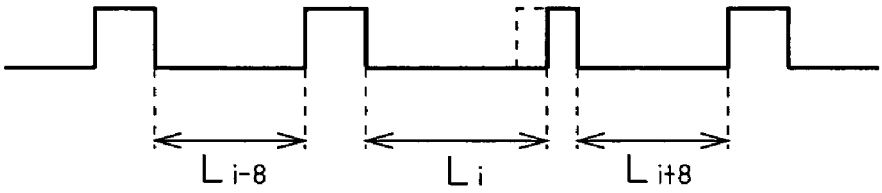
FIG. 11 shows an example of read data in the presence of a thin-line nozzle.

On the other hand, when the i-th nozzle 11*a* is not judged to be a clogged nozzle, the comparison operation part 253 then judges whether the i-th nozzle 11*a* is a so-called "thin-line nozzle" such that a line printed by the ink ejected therefrom has a reduced width or not (in Step S11). Specifically, the i-th nozzle 11*a* is judged to be a thin-line nozzle when the line-to-line spacing L1 corresponding to the i-th nozzle 11*a* is outside a proper range (e.g., $L_i<L_c-d$ or $L_i>L_c+d$ where $d>0$) and the preceding and following line-to-line spacings $L_{i-8}$ and $L_{i+8}$ are within a proper range (e.g., $L_c-d \leqq L_{i-8} \leqq L_c+d$ and $L_c-d \leqq L_{i+8} \leqq L_c+d$), as shown in FIG. 11. The comparison operation part 253 stores the result of the judgment (in Step S12) when the i-th nozzle 11*a* is judged to be a thin-line nozzle. Then, the processing proceeds to Step S15.

Figure 12:
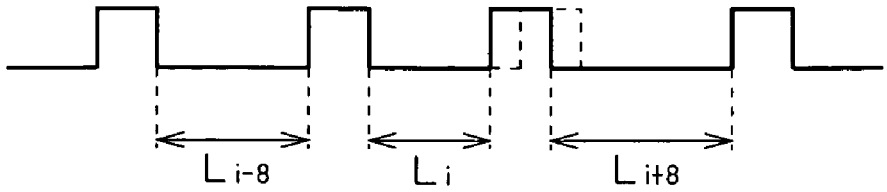
FIG. 12 shows an example of read data in the presence of an improper-droplet-path nozzle.

On the other hand, when the i-th nozzle 11*a* is not judged to be a thin-line nozzle, the comparison operation part 253 then judges whether the i-th nozzle 11*a* is a so-called "improper-droplet-path nozzle" such that a droplet of ink ejected therefrom follows an improper path or not (in Step S13). Specifically, the i-th nozzle 11*a* is judged to be an improper-droplet-path nozzle when the i-th nozzle 11*a* satisfies all of the following conditions: the line-to-line spacing $L_i$ corresponding to the i-th nozzle 11*a* is outside a proper range (e.g., $L_i<L_c-d$ or $L_i>L_c+d$ where $d>0$); the line-to-line spacing $L_{i+8}$ corresponding to its adjacent nozzle 11*a* is outside a proper range (e.g., $L_{i+8}<L_c-d$ or $L_{i+8}>L_c+d$ where $d>0$); and the sum of the line-to-line spacing $L_i$ and the line-to-line spacing $L_{i+8}$ is approximately twice the ideal line-to-line spacing $L_c$ (e.g., $2\ L_c-d \leqq L_i+L_{i+8} \leqq 2\ L_c+d$), as shown in FIG. 12. The comparison operation part 253 stores the result of the judgment (in Step S14) when the i-th nozzle 11*a* is judged to be an improper-droplet-path nozzle.

After the completion of the above-mentioned judgment processes, the comparison operation part 253 judges whether the nozzle number i is equal to the number $I_{max}$ of nozzles 11*a* contained in a corresponding one of the recording heads 11 or not (in Step S15). When the nozzle number i is not equal to the number $I_{max}$ of nozzles 11*a*, the comparison operation part 253 increments the nozzle number i by 1 (in Step S16), and executes Steps S8 to S15 described above again. That is, the comparison operation part 253 judges whether there is an abnormality in the next nozzle 11*a* in the same recording head 11 or not.

On the other hand, when the nozzle number i is equal to the number $I_{max}$ of nozzles 11*a*, the judgment processes for all of the nozzles 11*a* contained in one of the recording heads 11 are completed. Then, the comparison operation part 253 judges whether the recording head number n is equal to the number $N_{max}$ of recording heads 11 or not (in Step S17). When the recording head number n is not equal to the number $N_{max}$ of recording heads 11, the comparison operation part 253 increments the recording head number n by 1 (in Step S18), and executes Steps S8 to S17 described above again. That is, the comparison operation part 253 judges whether there is an abnormality in a nozzle 11*a* contained in the next recording head 11 or not.

When the recording head number n is equal to the number $N_{max}$ of recording heads 11 in Step S17, the judgment processes for the nozzles 11*a* contained in all of the recording heads 11 are completed. Then, the results of inspection stored in Steps S10, S12 and S14 described above are displayed by the display part 280 (in Step S19). This completes the inspection of the nozzles 11*a* for abnormalities in the printing apparatus 1.

As described hereinabove, the printing apparatus 1 reads the test patterns 90 recorded on the printing paper 9 at a resolution lower than the resolution of the recording heads 11. This allows the automatic and fast reading of the test patterns 90. Additionally, the printing apparatus 1 performs the interpolation process on the read data, and judges whether there is an abnormality in the nozzles 11*a* or not, based on the read data subjected to the interpolation process. This reproduces the positions of and spacing between the lines 91 recorded on the printing paper 9 with high accuracy to achieve the exact judgment as to whether there is an abnormality in the nozzles 11*a* or not. Therefore, the inspection with a high degree of reliability is accomplished.

<3. Modifications>

While the preferred embodiment according to the present invention has been described hereinabove, the present invention is not limited to the above-mentioned specific embodiment. For example, the judgment process may be performed based on the length of the "high" region although the judgment process is performed based on the length $L_i$ of the "low" region in the above-mentioned instance. Further, the judgment process may be performed based on not only the length of the "low" and "high" regions but also additional factors including the positions of the "low" and "high" regions with respect to the origin, the density value in the "high" region, and the like.

While the invention has been described in detail, the foregoing description is in all aspects illustrative and not restrictive. It is understood that numerous other modifications and variations can be devised without departing from the scope of the invention.

What is claimed is:

1. An inkjet printing apparatus comprising:

a recording head including a plurality of nozzles for ejecting ink onto printing paper, said recording head recording an image on said printing paper at a predetermined resolution;

a scanner for reading a predetermined test pattern recorded by said recording head at a resolution lower than the resolution of said recording head;

a threshold value setting element which receives a variable threshold value;

an interpolation processing part which generates interpolated data by performing an interpolation process on read data, said read data being read by said scanner; and a judgment part for judging whether there is an abnormality in said nozzles or not, based on said interpolated data, wherein the judgment part binarizes said interpolated data by using the threshold value as a reference, and judges whether there is an abnormality in said nozzles or not, based on said binarized interpolated data.

2. The inkjet printing apparatus according to claim 1, wherein said interpolation processing part performs the interpolation process on said read data to thereby generate said interpolated data with a resolution higher than the resolution of said recording head.

3. The inkjet printing apparatus according to claim 2, wherein the judgment part makes a comparison between said interpolated data generated by said interpolation processing part and ideal data based on an ideal test pattern to thereby judge whether there is an abnormality in said nozzles or not.

4. The inkjet printing apparatus according to claim 3, further comprising a transport part for transporting said printing paper, wherein, while being held stationary, said recording head records an image on said printing paper being transported in one direction by said transport part.

5. The inkjet printing apparatus according to claim 4, wherein said scanner includes a plurality of image pickup devices, said inkjet printing apparatus further comprising an averaging part for averaging data read by said plurality of image pickup devices.

6. The inkjet printing apparatus according to claim 1, wherein the threshold value is varied in accordance with a color of ink and a color of printing paper.

7. A method of inspecting a plurality of nozzles for abnormalities in an inkjet printing apparatus including a recording head, said recording head including said plurality of nozzles, said plurality of nozzles ejecting ink onto printing paper, said recording head recording an image on said printing paper, said method comprising the steps of:

(a) recording a test pattern on said printing paper at a predetermined resolution by means of said recording head;

(b) reading said test pattern at a resolution lower than said predetermined resolution;

(c) generating interpolated data by performing an interpolation process on read data, said read data being read in said step (b);

(d) receiving a variable threshold value; and (e) judging whether there is an abnormality in said nozzles or not, based on said interpolated data, wherein in said step (e), said interpolated data is binarized by using the threshold value as a reference, and whether there is an abnormality in said nozzles or not is judged based on said binarized interpolated data.

8. The method according to claim 7, wherein said interpolated data with a resolution higher than the resolution of said recording head is generated in said step (c) by performing the interpolation process on said read data.

9. The method according to claim 8, wherein whether there is an abnormality in said nozzles or not is judged in said step (e) by making a comparison between said interpolated data generated in said step (c) and ideal data based on an ideal test pattern.

10. The method according to claim 9, wherein said recording head held stationary records said test pattern on said printing paper being transported in one direction in said step (a).

11. The method according to claim 10, wherein said test pattern is read by a plurality of image pickup devices, and data read by said plurality of image pickup devices are averaged in said step (b).

12. The method according to claim 7, wherein the threshold value is varied in accordance with a color of ink and a color of printing paper.

13. An article of manufacture comprising a program stored on a computer readable storage medium which, when executed by a computer included in a controller included in an inkjet printing apparatus, said inkjet printing apparatus including a recording head having a plurality of nozzles for ejecting ink onto printing paper, a scanner for reading an image recorded on the printing paper, and the controller for controlling said recording head and said scanner, causes said computer to perform the functions of:

(a) recording a test pattern on said printing paper at a predetermined resolution by means of said recording head;

(b) reading said test pattern at a resolution lower than said predetermined resolution by means of said scanner;

(c) generating interpolated data by performing an interpolation process on read data, said read data being read by said function (b);

(d) receiving a variable threshold value; and (e) judging whether there is an abnormality in said nozzles or not, based on said interpolated data, wherein said function (e) binarizes said interpolated data by using the threshold value as a reference, and judges whether there is an abnormality in said nozzles or not, based on said binarized interpolated data.

14. The article of manufacture according to claim 13, wherein said function (c) performs the interpolation process on said read data to thereby generate said interpolated data with a resolution higher than the resolution of said recording head.

15. The article of manufacture according to claim 14, wherein said function (e) makes a comparison between said interpolated data generated by said function (c) and ideal data based on an ideal test pattern to thereby judge whether there is an abnormality in said nozzles or not.

16. The article of manufacture according to claim 15, wherein said function (a) causes said recording head held stationary to record said test pattern on said printing paper being transported in one direction.

17. The article of manufacture according to claim 16, wherein said function (b) causes a plurality of image pickup devices to read said test pattern, and averages data read by said plurality of image pickup devices.

18. The article of manufacture according to claim 13, wherein the threshold value is varied in accordance with a color of ink and a color of printing paper.

* * * * *